US008096672B2

(12) United States Patent
Mandy et al.

(10) Patent No.: US 8,096,672 B2
(45) Date of Patent: Jan. 17, 2012

(54) METHOD OF EQUALIZING LIGHT LEVELS BETWEEN LED LIGHT FIXTURES

(75) Inventors: Terry Roy Mandy, Paradise Valley, AZ (US); Dalton John Mandy, Scottsdale, AZ (US); Brandon Roy Mandy, Scottsdale, AZ (US)

(73) Assignee: Man-D-Tec, Inc., Scottsdale, AZ (US)

( * ) Notice: Subject to any disclaimer, the term of this patent is extended or adjusted under 35 U.S.C. 154(b) by 0 days.

(21) Appl. No.: 12/917,054

(22) Filed: Nov. 1, 2010

(65) Prior Publication Data

US 2011/0044047 A1 Feb. 24, 2011

Related U.S. Application Data

(62) Division of application No. 12/207,795, filed on Sep. 10, 2008.

(51) Int. Cl.
*F21S 8/02* (2006.01)
*F21V 9/14* (2006.01)

(52) U.S. Cl. ..... 362/147; 362/19; 362/295; 362/397

(58) Field of Classification Search ..... 362/19, 362/147, 283, 295, 322, 397
See application file for complete search history.

(56) References Cited

U.S. PATENT DOCUMENTS 1,767,988 A 6/1930 Knapp
2,835,791 A 5/1958 Horwitz
3,189,788 A 6/1965 Cady
3,336,473 A 8/1967 Buzan
3,760,179 A 9/1973 Addington, Jr.
3,808,499 A 4/1974 Edwards
4,032,828 A 6/1977 Strobl et al.
4,071,749 A 1/1978 Balogh
4,156,891 A 5/1979 Roche
4,218,725 A 8/1980 Heffner et al.
4,223,232 A 9/1980 Bulat
4,234,907 A 11/1980 Daniel
4,241,871 A 12/1980 Newell, III et al.
4,271,621 A 6/1981 Garcia et al.
4,441,143 A 4/1984 Richardson, Jr.
4,504,894 A 3/1985 Reibling
4,520,436 A 5/1985 McNair et al.
4,587,597 A 5/1986 Meyers
4,682,078 A 7/1987 Pascilade
4,697,890 A * 10/1987 Crookston et al. ..... 362/19
4,727,291 A 2/1988 Bavaro
4,749,908 A 6/1988 Stifter
4,751,398 A 6/1988 Ertz, III
4,802,065 A 1/1989 Minter et al.
4,875,553 A 10/1989 Smith et al.
4,885,663 A 12/1989 Parker
4,905,579 A 3/1990 Dame
4,907,132 A 3/1990 Parker
4,947,291 A * 8/1990 McDermott ..... 362/295
4,977,818 A 12/1990 Taylor et al.
5,003,432 A 3/1991 Mandy
5,005,108 A 4/1991 Pristash et al.
5,021,928 A 6/1991 Daniel
(Continued)

*Primary Examiner* — Y My Quach Lee
(74) *Attorney, Agent, or Firm* — Reising Ethington P.C.

(57) ABSTRACT

A method is provided for equalizing emitted light levels between light fixtures that use LEDs to produce light. The method includes gaining access to LED light fixtures from within a compartment in which the fixtures are mounted, and adjusting LED dimmers of the LED light fixtures to adjust the light emission levels of the LED light fixtures to generally match one another.

8 Claims, 6 Drawing Sheets

U.S. PATENT DOCUMENTS

| | | | | |
|---|---|---|---|---|
| 5,025,349 | A | 6/1991 | Gow | |
| 5,123,875 | A | 6/1992 | Eubank et al. | |
| 5,145,247 | A | 9/1992 | Mandy | |
| 5,161,879 | A | 11/1992 | McDermott | |
| 5,568,964 | A | 10/1996 | Parker et al. | |
| 5,613,751 | A | 3/1997 | Parker et al. | |
| 5,618,096 | A | 4/1997 | Parker et al. | |
| 5,850,126 | A | 12/1998 | Kanbar | |
| 5,876,107 | A | 3/1999 | Parker et al. | |
| 5,894,686 | A | 4/1999 | Parker et al. | |
| 5,895,115 | A | 4/1999 | Parker et al. | |
| 5,921,652 | A | 7/1999 | Parker et al. | |
| 6,030,089 | A | 2/2000 | Parker et al. | |
| 6,079,838 | A | 6/2000 | Parker et al. | |
| 6,158,867 | A | 12/2000 | Parker et al. | |
| 6,185,356 | B1 | 2/2001 | Parker et al. | |
| 6,712,481 | B2 | 3/2004 | Parker et al. | |
| 6,752,505 | B2 | 6/2004 | Parker et al. | |
| 6,764,196 | B2 * | 7/2004 | Bailey | 362/147 |
| 6,827,456 | B2 | 12/2004 | Parker et al. | |
| 6,872,220 | B2 | 3/2005 | Williams et al. | |
| 6,874,925 | B2 | 4/2005 | Page et al. | |
| 7,077,544 | B2 | 7/2006 | Parker | |
| 7,114,829 | B2 * | 10/2006 | Lai | 362/295 |
| 7,261,453 | B2 | 8/2007 | Morejon et al. | |
| 2004/0125246 | A1 | 7/2004 | Okamori et al. | |
| 2005/0190345 | A1 | 9/2005 | Dubin et al. | |
| 2006/0038192 | A1 | 2/2006 | Williams | |
| 2007/0242461 | A1 | 10/2007 | Reisenauer et al. | |

* cited by examiner

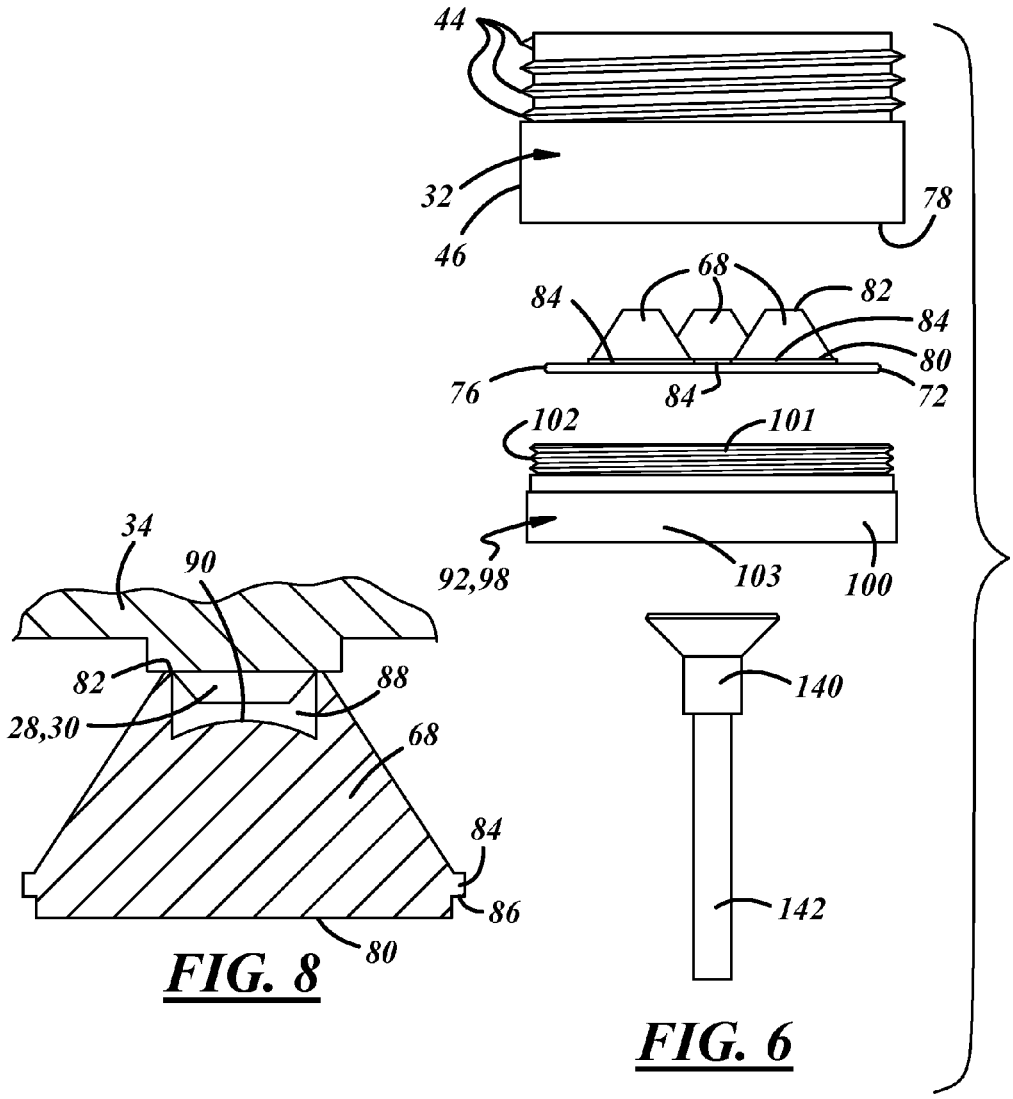
FIG. 8
FIG. 6
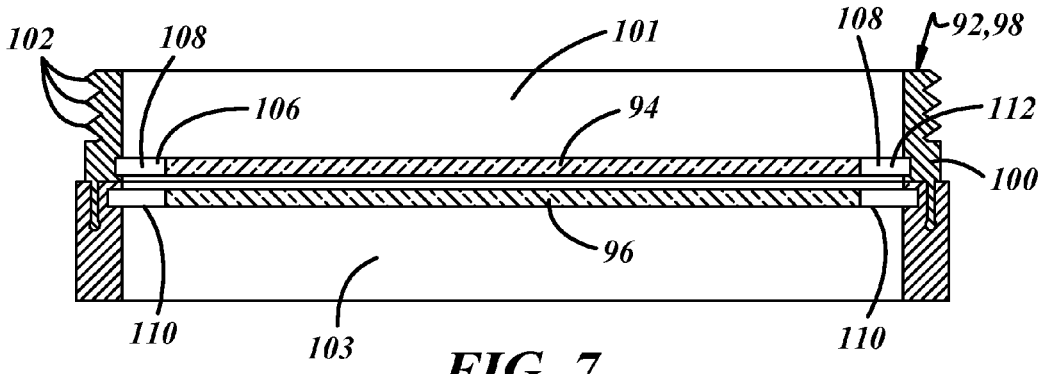
FIG. 7

| JUMPER 1 | JUMPER 2 | OUTPUT |
|---|---|---|
| OPEN | OPEN | 350mA |
| OPEN | SHORTED | 700mA |
| SHORTED | SHORTED | 1050mA |

METHOD OF EQUALIZING LIGHT LEVELS BETWEEN LED LIGHT FIXTURES

CROSS-REFERENCES TO RELATED APPLICATIONS

This application is a division of U.S. Ser. No. 12/207,795, filed Sep. 10, 2008.

STATEMENT REGARDING FEDERALLY SPONSORED RESEARCH OR DEVELOPMENT

Not Applicable

BACKGROUND OF THE INVENTION

1. Field of the Invention

This invention relates generally to interior illumination assemblies for adjustably illuminating the interior of a compartment such as an elevator passenger cab.

2. Description Of The Related Art Including Information Disclosed Under 37 CFR 1.97 AND 1.98

It is known for screw-in type replaceable LED lamps to be used in lamp housings such as track lighting housings as shown in U.S. Pat. No. 5,850,126 issued Dec. 15, 1998; and United States Patent Application Publication No. 2007/0242461 A1 filed Oct. 30, 2006. However, existing LED lamp designs are generally adapted to retrofit such LED lamps into lamp housings designed to accept standard screw-in type incandescent lamps.

It is also known for polarizing filters to be used to control the amount of light emitted from a light source. For example, U.S. Pat. No. 5,161,879 issued 10 Nov. 1992 to McDermott, discloses a handheld flashlight having stationary and rotatable polarizing filters coaxially supported in and oriented across the paths of light beams emittable from an array of LEDs and/or an incandescent bulb carried by a lamp module of a cartridge assembly of the flashlight such that, when the LEDs and/or bulb are energized, their emitted light must pass through both filters before exiting the flashlight case. The stationary filter is fixed relative to a flashlight case. The flashlight case houses the cartridge assembly and supports the cartridge assembly for rotation within the case. The rotatable filter caps the lamp module such that rotation of the cartridge assembly with its lamp module within the flashlight case causes rotation of the rotatable filter relative to the stationary filter between conditions of parallel polarization (high projected light intensity) and cross-polarization (low projected light intensity). The luminous intensity of a light beam emitted from the lamp of the flashlight is adjustable by rotating the rotatable polarizing filter relative to the stationary polarizing filter. However, the McDermott flashlight isn't adapted for mounting above a ceiling panel of a room or compartment such as, for example, an elevator passenger compartment and, even if it were, it would not allow an operator to rotate the polarizing filters relative to one another without also rotating the lamp module relative to the flashlight case.

BRIEF SUMMARY OF THE DISCLOSURE

A method is provided for equalizing emitted light levels between interior illumination assemblies that use LEDs to produce light. According to this method, one can equalize emitted light levels between interior illumination assemblies by first providing a compartment with at least two illumination assemblies that each comprise at least one LED, and at least one assembly of which comprises an LED dimmer configured to be accessible from within the compartment to adjust the amount of light emitted by the assembly into the compartment. The LED dimmer of at least one illumination assembly may then be accessed from within the compartment, and, by adjusting the LED dimmer (or dimmers), the light emission level of at least one of the illumination assemblies may be adjusted to generally match that of another of the illumination assemblies. This allows the emitted light levels of two or more illumination assemblies to be adjusted to compensate for changes in relative interior illumination assembly brightness caused by aging of LEDs and/or replacement of certain LEDs of the interior illumination assemblies with newer, brighter LEDs.

The step of providing an elevator with at least two interior illumination assemblies may include providing at least one illumination assembly comprising an LED dimmer having two polarizing filters carried by the lamp housing below the lamp and coaxially supported for relative rotation between conditions of parallel polarization and cross-polarization, a first filter of the two polarizing filters being fixed against rotation relative to the lamp housing, and a second filter of the two polarizing filters being supported for rotation relative to the first filter. The step of adjusting the LED dimmer may then include rotating one of the two polarizing filters relative to the other filter.

The step of providing at least one illumination assembly may include the first filter being an upper filter of the two polarizing filters and the second filter being a lower filter of the two polarizing filters. The step of adjusting the LED dimmer may then include rotating the lower filter of the two polarizing filters relative to the upper filter.

The step of adjusting the LED dimmer may include rotating the lower filter of the two polarizing filters of an LED dimmer of a relatively brighter interior illumination assembly in a direction diminishing light transmission through the filters.

The step of adjusting the LED dimmer may include rotating the lower filter of the two polarizing filters of an LED dimmer of a relatively darker interior illumination assembly in a direction increasing light transmission through the filters.

The step of gaining access to the LED dimmer may include the steps of providing a suction cup and applying the suction cup to the lower filter. The step of rotating the lower filter may then include moving the suction cup such that rotational motion is imparted to the lower filter.

The step of applying a suction cup to the lower filter may include applying the suction cup to the lower filter such that a central axis of the suction cup is generally aligned with a rotational axis of the lower filter. The step of moving the suction cup may then include rotating the suction cup about its central axis.

The step of providing a suction cup may include providing a suction cup coaxially supported on an elongated member. The step of applying the suction cup to the lower filter may then include holding the elongated member and directing the suction cup toward and into coaxial alignment and engagement with the lower filter, and the step of moving the suction cup may then include rotating the elongated member about its longitudinal axis.

BRIEF DESCRIPTION OF THE SEVERAL VIEWS OF THE DRAWINGS

These and other features and advantages will become apparent to those skilled in the art in connection with the following detailed description and drawings of one or more embodiments of the invention, in which:

FIG. 6 is an exploded view of the LED module and filter module of interior illumination assembly of FIG. 2 and also showing a suction cup positioned to engage and rotate a lower filter of the filter assembly;

FIG. 7 is a front cross-sectional view of the filter module of the interior illumination assembly of FIG. 2;

FIG. 8 is a cross-sectional view of an LED magnifying lens of the interior illumination assembly of FIG. 2;

DETAILED DESCRIPTION OF INVENTION EMBODIMENT(S)

Figure 1:
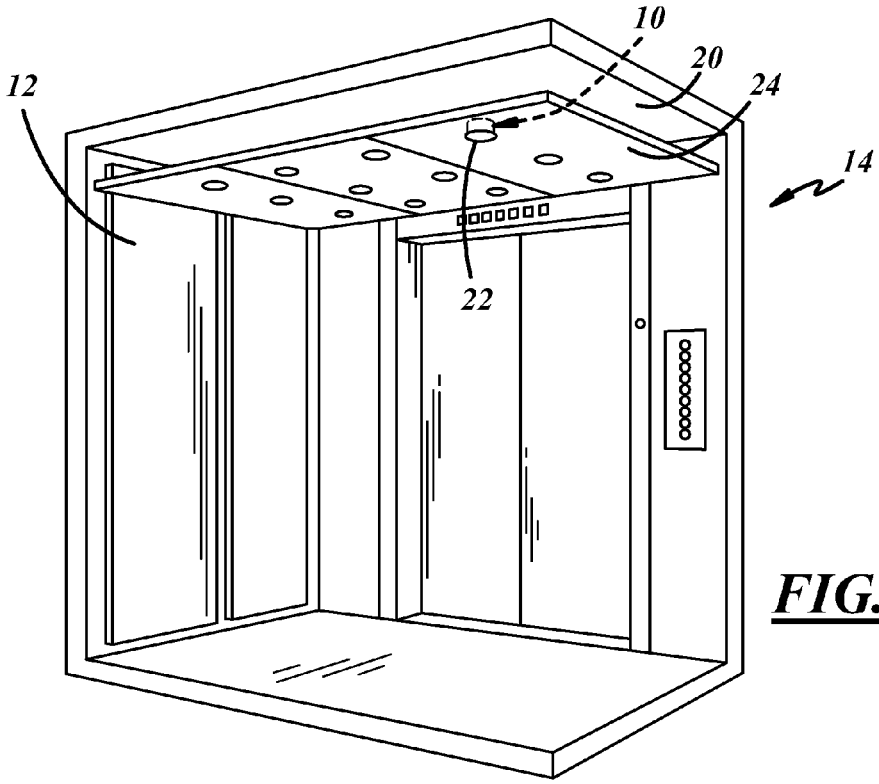
FIG. 1 is a cut-away perspective view of an elevator having installed a plurality of interior illumination assemblies constructed according to the invention.

An interior illumination assembly for adjustably illuminating the interior of a room or compartment 12 such as a passenger compartment or cab 12 of an elevator 14 is shown at 10 in FIGS. 1-12. Although the embodiment of the assembly 10 shown in the drawings is an elevator ceiling application in which light is directed downwardly into an elevator passenger cab 12, other embodiments of the assembly 10 may be adapted to illuminate any interior space in which light may be directed in any desired or suitable direction. Hence, where this description uses words such as "upper", "upward", "lower", and "downward"; such words are intended as convenient directional modifiers describing relative positions of various components. They are not intended to limit the assembly 10 to a vertical orientation or attitude or to downwardly-directed lighting applications. The assembly 10 may include a generally canister-shaped lamp housing 16 that may comprise cast metal, may be configured to be mounted on a ceiling panel 24 of, for example, an elevator 14, and may have an opening 18 at a lower end of the housing 16. More specifically, the lamp housing 16 may be mounted in, for example, an elevator plenum 20 in a position to direct light downward through a hole 22 formed in a ceiling panel 24 defining the elevator plenum. The lamp housing 16 may include a retainer clamp 26 positioned to securely mount the lamp housing 16 to a ceiling panel 24. The retainer clamp 26 may be of any suitable type known in the art to include the types disclosed in U.S. Pat. No. 5,003,432 issued 26 Mar. 1991; U.S. Pat. No. 5,408,394 issued 18 Apr. 1995; U.S. Pat. No. 5,412,542 issued 2 May 1995; or U.S. Pat. No. 7,066,617 issued 27 Jun. 2006; which are all assigned to the assignee of the present invention and are incorporated herein by reference. The retainer clamp 26 locks the lamp housing 16 to a ceiling panel 24. In an elevator application this would help to prevent the assembly 10 from breaking loose and falling from a ceiling panel 24 in an annual elevator drop test or actual elevator malfunction that results in sudden deceleration.

A lamp 28 may be supported within the lamp housing 16 in a position to emit light from the housing 16 through the housing opening 18 into a compartment 12 when the lamp 28 is energized. The lamp 28 may comprise a light-emitting diode (LED) and, as shown in the drawings, may include three high-powered light-emitting diodes (LEDs) 30 of the type having the specifications: 100+ lumens, 3 watt, 2800-3050K (warm white) @ 3.5V available from Cree of Durham, N.C., but in other embodiments may include any suitable type and number of LEDs. The assembly 10 is configured to allow for LEDs 30 to be removed from the assembly 10 from within a compartment 12 in which the assembly 10 is installed and without having to remove the lamp housing 16. In other words, a person can gain access to and remove the LEDs 30 from the assembly 10 from a position standing in a compartment such as the passenger compartment 12 of the elevator 14. There is no need for a person to gain access to the assembly 10 from above, e.g., through an upper access panel or trap door of an elevator 14.

The LEDs 30 may be carried by a generally disk or puck-shaped LED module 32 that is removably received by the lamp housing 16. The LED module 32 and lamp housing 16 may be sized for mounting in a low-clearance space such as an elevator plenum 20. The LED module 32 may include a thermal conductor 34 which may include a generally cylindrical die-cast metal heat sink 34 that may carry the LEDs 30. The LEDs may be carried in a triangular array on a lower axially-recessed circular upper wall 36 of a lower cylindrical recess 38 of the heat sink 34 such that the LEDs 30 can dissipate heat through thermally conductive communication with the heat sink 34 and such that light emissions from the LEDs 30 are directed downward through the housing opening 18 when the LED module 32 is received in the lamp housing 16. In other words, the lamp housing 16 removably receives the LED module 32 and supports the LED module 32 in a position to direct light emitted from the LEDs 30 downward into a compartment such as the passenger cab of the elevator 14.

Figure 2:
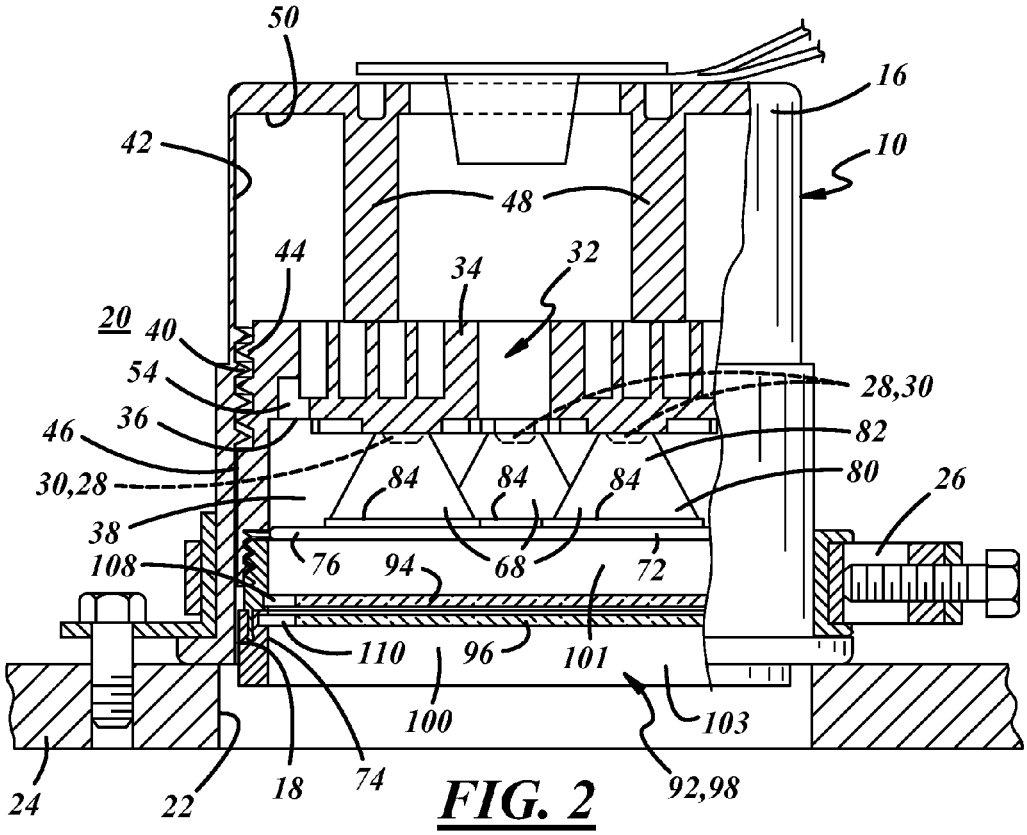
FIG. 2 is a partially cut-away front cross-sectional view of one of the interior illumination assemblies of FIG. 1.
Figure 3:
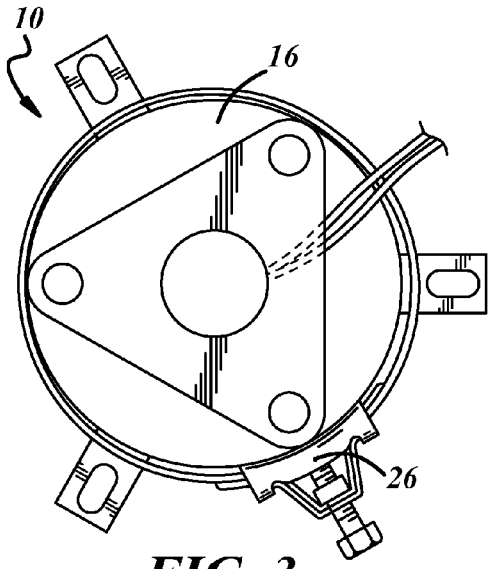
FIG. 3 is a top view of the interior illumination assembly of FIG. 2.
Figure 4:
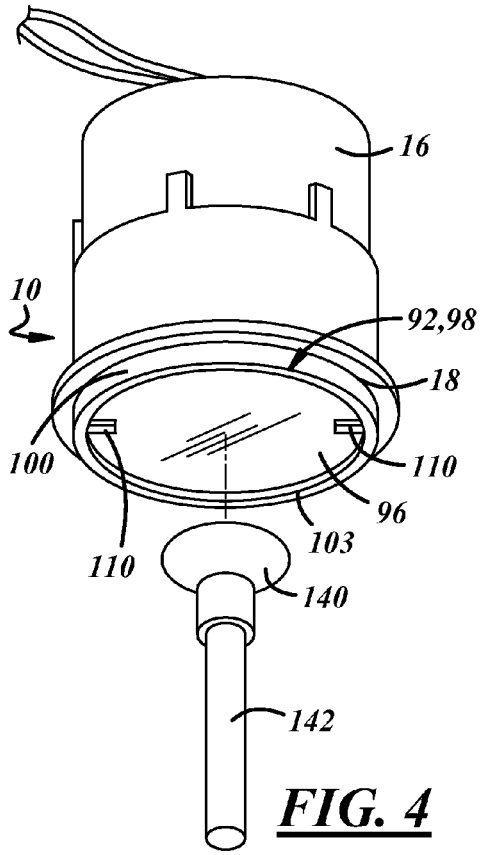
FIG. 4 is an isometric bottom-front view of the interior illumination assembly of FIG. 2 removed from an elevator ceiling panel for clarity and showing a suction cup being positioned to engage and rotate a lower polarizing filter of the assembly.
Figure 5:
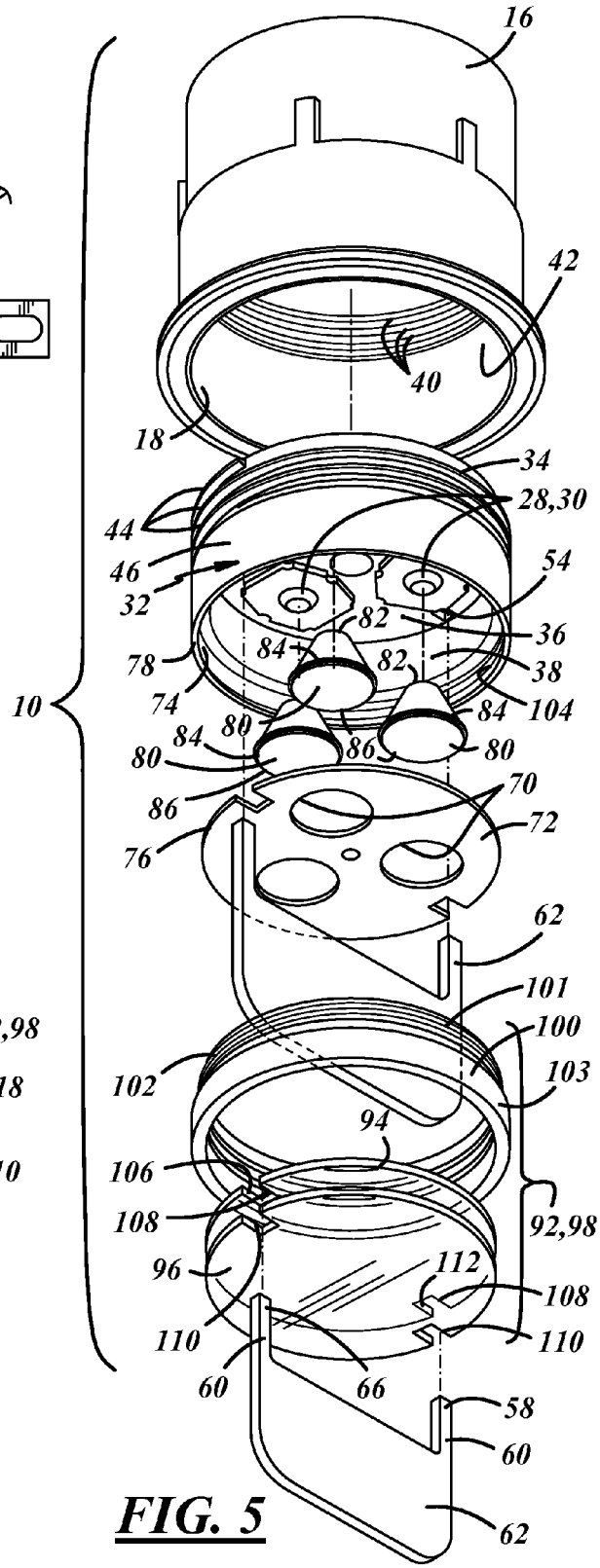
FIG. 5 is an exploded view of the interior illumination assembly of FIG. 2 also showing, in two places, an installation wrench for installing an LED module and a filter module of the assembly.
Figure 10:
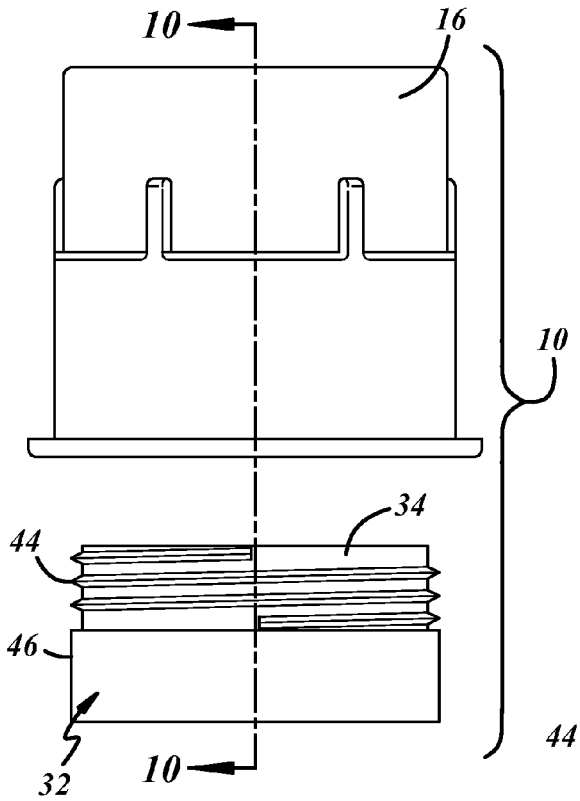
FIG. 10 is an exploded view of a lamp housing and LED module of the interior illumination assembly of FIG. 2.
Figure 11:
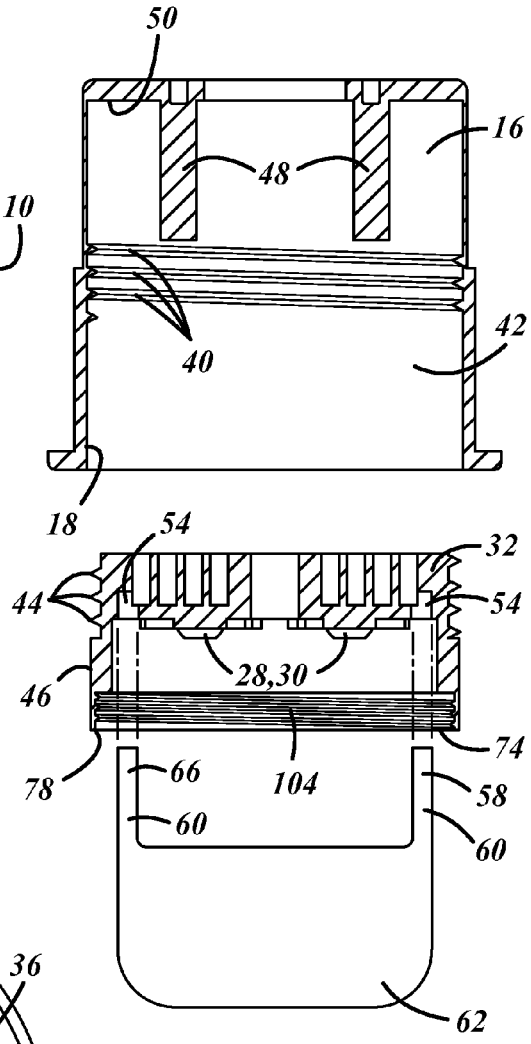
FIG. 11 is a cross-sectional exploded view of the lamp housing and LED module of the interior illumination assembly of FIG. 2 and also showing an installation wrench being positioned to engage the LED module for the purpose of installing the LED module in the lamp housing.

As best shown in FIGS. 2, 5, and 6, one or more housing detents 40 may be provided in the lamp housing 16 to receive one or more corresponding module detents 44 provided on the LED module 32. As best shown in FIG. 2 the housing and module detents 40, 44 may be arranged to engage and hold the LED module 32 and housing 16 together in respective positions providing mechanical and thermal connections between the LED module 32 and the lamp housing 16. The housing and module detents 40, 44 are further arranged and shaped to engage through simple axial insertion of the LED module 32 into the lamp housing 16 and rotation of the LED module 32 relative to the housing 16. The rotation of the LED module 32 in this operation causes the module detents 44 to engage the housing detents 40 in such a way as to resist axial separation of the LED module from the lamp housing. As best shown in FIGS. 2 and 5, the housing and module detents 40, 44 may comprise threads cast or otherwise formed into an inner cylindrical wall 42 of the lamp housing 16 and into an outer circumferential surface 46 of the module heat sink 34, respectively, such that the threads of the housing detent 40 may receive the threads of the module detent 44 in threaded engagement. The housing may include a stop that may include two cast-in standoffs or posts 48 that may extend integrally and axially downward from a circular upper wall 50 of the lamp housing 16 and engage the thermal conductor 34 of the LED module 32 to limit the threaded advance of the LED module 32 to a desired depth into the lamp housing 16 during assembly, to provide a thermal conduction path from the module heat sink 34 to the lamp housing 16, and to lock the LED module 32 against rotating or even falling out of the lamp housing 16 during, for example, sudden decelerations of the type that occur in elevator applications during an elevator drop test or an actual elevator malfunction.

Figure 9:
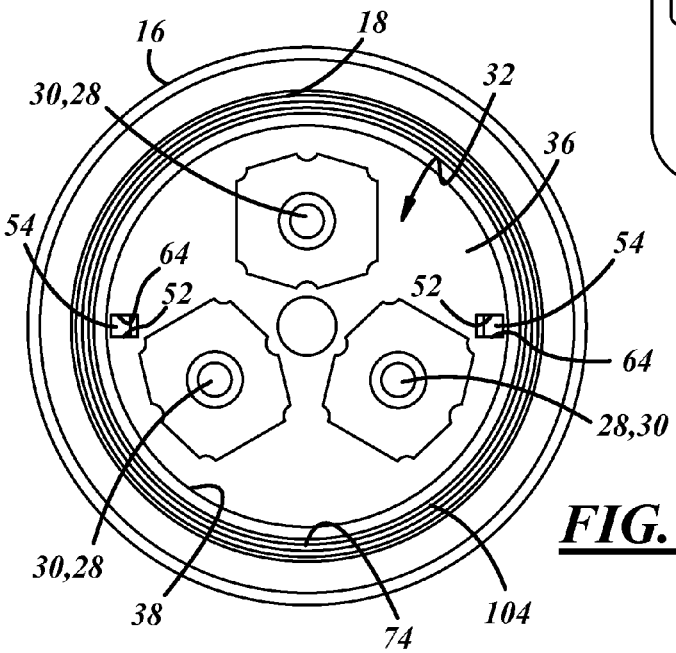
FIG. 9 is a bottom view of the lamp housing and LED module of interior illumination assembly of FIG. 2.

As is best shown in FIG. 9, the LED module 32 may include two LED module removal detent surfaces 52 disposed in two small holes or LED module engagement apertures 54 disposed in diametrically opposite positions on the circular upper wall 36 of the LED module 32 and positioned to be engaged by respective wrench first detent surfaces 58 on complementary-shaped prongs 60 of a spanner wrench 62 shaped and positioned to allow a user to remove the LED module 32 from the lamp housing 16 by using the wrench 62 to engage and apply counterclockwise torque to and rotate the LED module 32 relative to the lamp housing 16.

The LED module 32 may also include two LED module installation detent surfaces 64 disposed in the same small apertures 54 where, as is again best shown in FIG. 9, the LED module removal detent surfaces 52 are disposed. The LED module installation detent surfaces 64 may be positioned to be engaged by respective wrench second detent surfaces 66 that may be disposed on the same complementary-shaped wrench prongs 60 as the wrench first detent surfaces 58 so that an installer can install the LED module 32 by using the wrench 62 to engage and apply clockwise torque to and rotate the LED module 32 relative to the lamp housing 16. This arrangement allows a user possessing such a wrench 62 to remove the LED module 32 from the lamp housing 16 and to replace the LED module 32 in the lamp housing 16, and to accomplish either procedure from a position within the compartment 12.

The LED module 32 may also carry three magnifying lenses 68 supported in a triangular array and in axial alignment with the respective LEDs 30 and disposed between the three respective LEDs 30 and the compartment 12. The three magnifying lenses 68 may be so positioned to maximize the amount of light directed from the three LEDs 30 into the compartment 12. The lenses 68 may be carried in respective circular apertures 70 formed in a circular disk-shaped aluminum LED lens plate 72 that may be supported across a lower opening 74 of the lower cylindrical recess 38 of the heat sink 34. In other words, an outer circumferential rim 76 of the LED lens plate 72 may be secured to a circular heat sink rim 78 that defines the lower opening 74 of the lower cylindrical recess 38 of the heat sink 34.

Each magnifying lens 68 may have the general shape of a frusto-conical prism having a circular lower surface 80 that may be disposed axially opposite a circular upper apex 82. Each magnifying lens 68 may also include an annular rim 84 that extends radially and integrally outward from around the lens 68 adjacent the lower surface 80 and includes a circumferential land 86 shaped and sized to engage a portion of the LED lens plate 72 surrounding one of the circular apertures 70 formed in the LED lens plate 72.

As is best shown in FIG. 8, each magnifying lens 68 may include a generally cylindrical LED receiver recess 88 at its apex. The LED receiver recess 88 of each magnifying lens 68 may be shaped and positioned to receive an LED 30 in a desired position relative to the lens 68. The three magnifying lenses 68 may be carried by the LED lens plate 72 in respective positions such that their LED receiver recesses 88 are positioned to receive the respective LEDs 30 when the LED lens plate 72 is installed on the heat sink 34, and such that light from the LEDs 30 is emitted downward through the lenses while heat conducted from the LEDs 30 is dispersed by the heat sink 34. The LED receiver recesses 88 of the magnifying lenses 68 may each include a convex base surface 90 shaped to further disburse and magnify the light emitted by the LEDs 30 through the magnifying lenses 68.

The assembly 10 may further include an LED dimmer 92 that is accessible from within the compartment 12 to adjust the amount of light emitted by the LEDs 30 into a compartment 12, e.g., the passenger cab of an elevator 14, in which the assembly 10 is installed. The LED dimmer 92 may comprise two polarizing filters 94, 96 carried by the lamp housing 16 below the lamp 28 and coaxially supported for relative rotation between conditions of parallel polarization (high projected light intensity) and cross-polarization (low projected light intensity). An upper filter 94 or the two polarizing filters may be secured against rotation relative to the lamp housing 16 and a lower filter 96 of the two filters may be free to rotate relative to the lamp housing 16. The filters 94, 96 may be oriented across a paths of light emitted from the LEDs 30 such that, when the LEDs 30 are energized, their emitted light passes through both filters 94, 96 allowing the intensity of emitted light to be controlled by relative rotation of the polarizing filters 94, 96.

The assembly 10 may include a polarizing filter module 98 which may comprise a two-part retainer ring 100 having an upper part 101 that supports the upper filter 94 of the polarizing filters 94, 96 against rotation relative to the retainer ring 100, and a lower part 103 that supports the lower filter 96 of the polarizing filters for rotation relative to the retainer ring 100 and the upper filter 94. As best shown in FIG. 7, the upper part 101 may be mechanically interlocked with the lower part 103 in such a way as to hold the two parts together axially while allowing the lower part 103 to rotate relative to the upper part 101. The polarizing filter module 98 may be removably installable in the lamp housing 16 such that the upper part 101 is supportable against rotation relative to the lamp housing 16 while the lower part 103 is free to rotate. More specifically, the upper part 101 of the retainer ring 100 may include exterior circumferential threads 102 engageable with corresponding interior circumferential threads 104 formed in the lower cylindrical recess 38 of the heat sink 34 which, as described above, is removably installable in the lamp housing 16 and supportable against rotation relative to the lamp housing 16. When the polarizing filter module 98 is installed in the cylindrical recess 38 of the heat sink 34 the retainer ring 100 is threadedly engaged with the cylindrical recess 38 with sufficient rotational force to insure that the lower filter 96 can be rotated relative to the upper filter 94 without rotating the retainer ring 100 relative to the heat sink 34 and lamp housing 16. This arrangement allows the polarizing filter module 98 to be installed in the lower cylindrical recess 38 of the heat sink 34 while the heat sink 34 is installed in the lamp housing 16, in such a way as to allow an operator to rotate the lower filter 96 relative to the upper filter 94 from a position within the compartment 12, e.g., the passenger cab of an elevator 14, in which the assembly 10 is installed, without also rotating the upper filter 94 relative to the lamp housing 16.

The polarizing filter module 98 may include two filter module removal detent surfaces 106 disposed in respective filter module engagement apertures 108 positioned to be engaged by the respective wrench first detent surfaces 58 disposed on respective wrench prongs 60 of the spanner wrench 62, which are shaped to allow an installer to apply counter-clockwise torque to and rotate the polarizing filter module 98 counter-clockwise relative to the lamp housing 16. The lower filter 96 may include lower lens apertures 110 axially alignable with the respective filter module engagement apertures 108 in which are disposed the filter module removal detent surfaces 106 in the upper filter 94, and which are shaped to allow prongs 60 of a spanner wrench 62 to extend through the lower lens apertures 110 of the lower filter 96 and engage the filter module removal detent surfaces 106 of the upper filter 94. This allows an installer to apply counter-clockwise torque to the filter module 98 to unthread and remove the filter module 98 from the lamp housing 16.

The polarizing filter module 98 may also include two filter module installation detent surfaces 112 disposed in the respective filter module engagement apertures 108. The filter module installation detent surfaces 112 may be positioned to be engaged by respective wrench second detent surfaces 66 disposed on the respective wrench prongs 60 of the spanner wrench 62 to allow an installer to apply clockwise torque to the filter module 98 to install the filter module 98 by rotating it clockwise relative to the lamp housing 16 and threading the module into the lamp housing 16. The lower lens apertures 110 may be axially aligned with the respective filter module engagement apertures 108 in which are disposed the filter module installation detent surfaces 112 in the upper filter 94 and may be shaped to allow the prongs 60 of the spanner wrench 62 to extend through the lower lens apertures 110 of the lower filter 96 and engage the installation detent surfaces of the upper filter 94 so that an installer can apply clockwise torque to the filter module 98 to install the filter module in the lamp housing 16. The upper lens apertures and lower lens apertures 110 may be spaced from each other and shaped generally the same as the LED module engagement apertures 54 so that the same wrench 62 may be shaped to both install and uninstall both the filter module 98 and the LED module 32.

Figure 12:
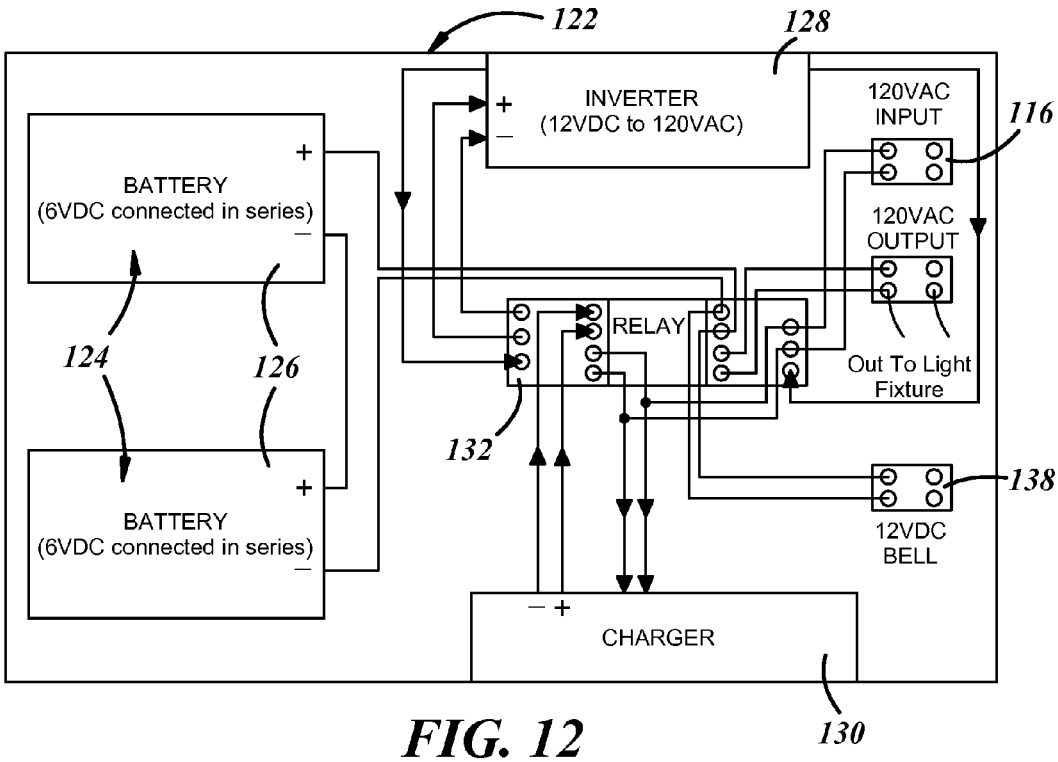
FIG. 12 is a schematic block diagram of an emergency power supply for the interior illumination assembly of FIG. 2.
Figure 13:
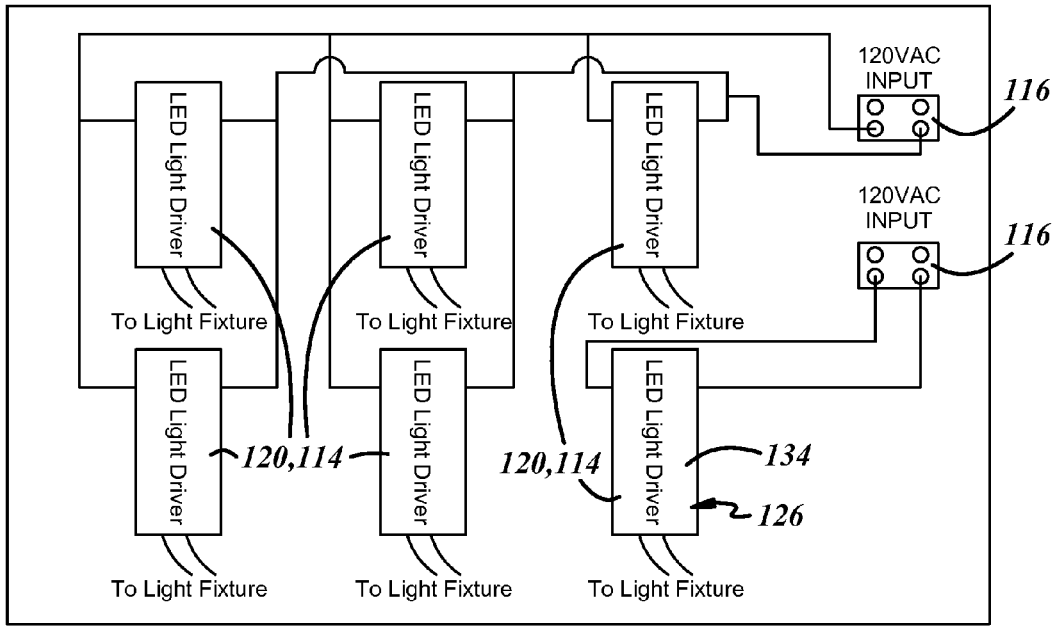
FIG. 13 is a schematic block diagram of power supplies for six of the interior illumination assemblies of FIG. 2.
Figure 14:
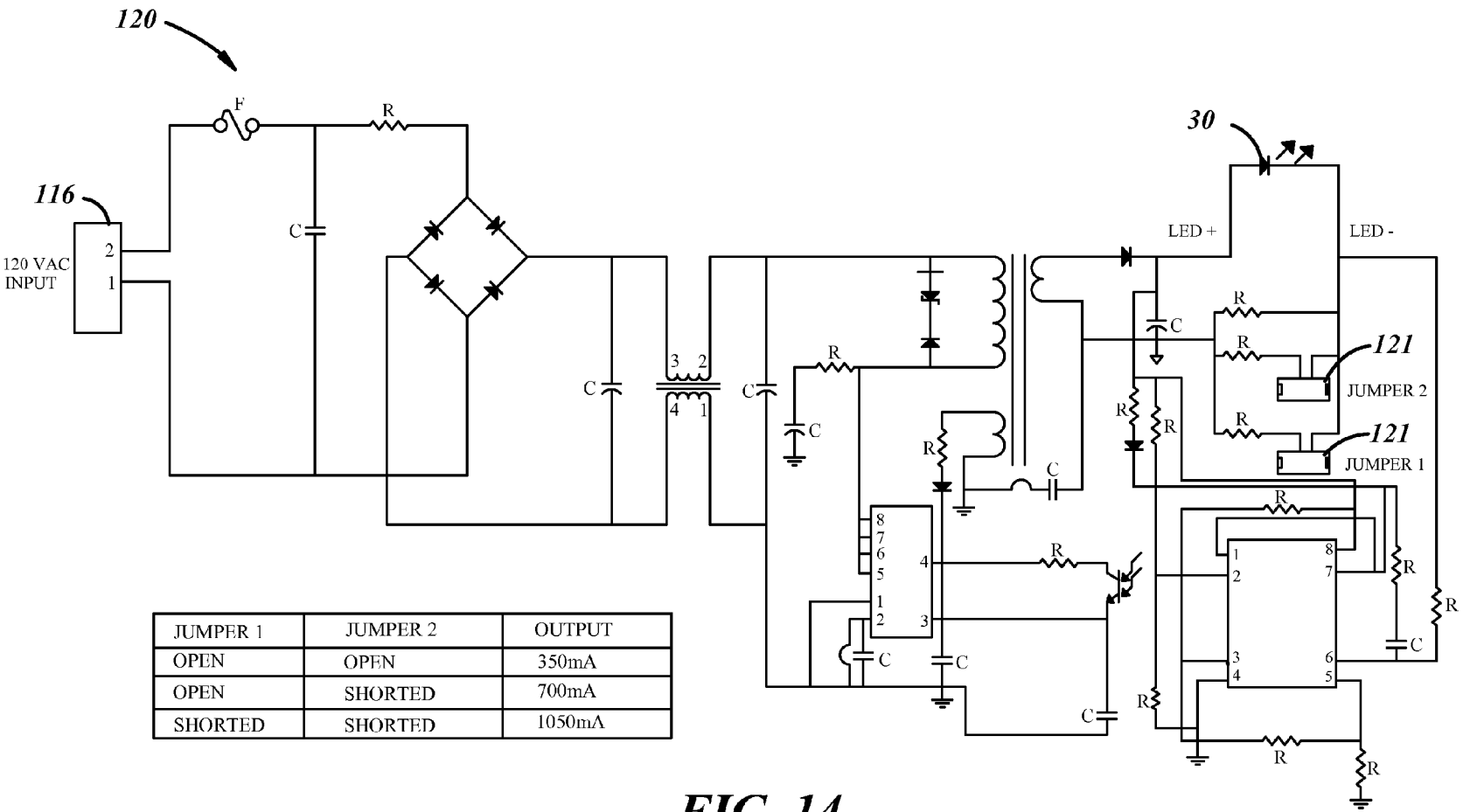
FIG. 14 is a schematic block diagram of an LED driver.

A single application may include a plurality of interior illumination assemblies 10, each including an LED dimmer 92. As shown in FIG. 12, each assembly 10 may each include an electrical power supply 114 that's electrically connected to the LEDs 30 of each assembly 10 and that conditions electrical power provided by an external electrical power source 116 such as an elevator power distribution system, to illuminate the LEDs 30 of each interior illumination assembly 10. Each power supply 114 may include an electronic driver, such as the one shown schematically at 120 in FIG. 14, that's connected between the external electrical power source 116 and one of the interior illumination assemblies to condition power supplied to the LEDs 30 of the interior illumination assembly. The external electrical power source 116 may provide 120 VAC electrical current, and each power supply 114 may include a 120 VAC input, 3-21 VDC output, 700 mA constant-current driver 120 that may be connected in parallel with the other such drivers 120 between the external electrical power source 116 and the LEDs 30 of each assembly 10 of the plurality of interior illumination assemblies 10, respectively, to convert the 120 VAC provided by the external electrical power source 116 to constant DC current suitable to energize the LEDs 30 of the interior illumination assemblies 10. Each driver 120 may also include two or more current jumpers 121 selectably connectable between a source of electrical power 116 and the LEDs 30 to regulate light output from the LEDs 30 and serve as either an alternative or supplemental LED dimmer 92. As shown in the FIG. 14 schematic representation of an exemplary LED driver 120, an output of 350 mA to the LEDs 30 may be realized by opening both current jumpers 121, an output of 700 mA may be realized by opening one and shorting the other current jumper 121, and an output of 1050 mA may be realized by shorting both current jumpers 121.

Where, for example, interior illumination assemblies 10 are installed in an elevator 14, the illumination assemblies 10 may also include an emergency illumination system 122. An emergency light power supply 124 for the emergency illumination system 122 may include a 12 VDC battery power source comprising two 6 VDC batteries 126 connected in series. The 12 VDC battery power source 126 may be connected to and energize an inverter 128 that is, in turn, connected to and provides power to the LEDs 30 in the event of a failure of the main power supply 114, to power at least two of the three LEDs 30 in one interior illumination assembly 10 for at least 4 hours in the event of a main electrical power supply 114 failure. In other words, one of the drivers powering one of the interior illumination assemblies 10, instead of being connected directly to the main external electrical power source 116, is normally connected to the main external electrical power source 116 through the emergency illumination system 122. Any of the interior illumination assemblies 10 may be powered through the emergency illumination system 122 in this way or may, alternatively, be connected directly to the external electrical power source 116 by, for example, jumper wires. The emergency illumination system 122 may also include a charger 130 connectable between the external electrical power source 116 and the batteries 126 to charge the batteries when external electrical power is available. A relay 132 is connected between the external electrical power source 116 and the charger 130, between the external electrical power source 116 and each of the drivers 120 connected to the interior illumination assemblies 10, between the charger 130 and the batteries 126, and between the inverter 128 and the driver 134 that's connected to the interior illumination assembly that's to be powered by the emergency illumination system 122 in the event of an external power source failure. When the external electrical power source 116 is applying 120 VAC to the relay 132, the relay 132 closes a circuit that allows electrical current to flow from the external electrical power source 116 to the drivers 120, and closes a circuit that allows electrical current to flow from the charger 130 to the batteries 126, but does not close an electrical circuit that would allow electrical power to be applied to the inverter 128. When the external electrical power source 116 fails, and is not applying 120 VAC to the relay 132, the relay is energized by 12 VDC applied by the batteries 126, opens the circuit that would otherwise allow electrical current to flow from the external electrical power source to the drivers 120, closes a circuit that allows 12 VDC electrical current to flow from the batteries 126 to the inverter 128 and 120 VAC to flow from the inverter 128 to the driver 134 that's connected to the interior illumination assembly intended to be powered by the emergency illumination system 122, and closes a circuit that allows 12 VDC to flow from the batteries 126 to an electrically-driven emergency bell 138.

In practice, emitted light levels may be equalized between interior illumination assemblies that use LEDs 30 to produce light in a compartment 12 such as an elevator passenger cab, by first providing the compartment 12 with a plurality of the interior illumination assemblies, each of which may comprise an LED dimmer 92 configured to be accessible from within the compartment 12 to adjust the amount of light emitted by the assembly 10 into a compartment 12 in which the assembly 10 is installed. A person then enters the compartment 12 and reaches up to gain access to the LED dimmers of the assemblies from within the compartment 12. The person may then adjust the light emission levels of the interior illumination assemblies by adjusting their respective LED dimmers, one at a time, to generally match that of a selected one of the interior illumination assemblies that is producing a desired light level. Where the dimmer 92 includes relatively rotatable polarizing filters 94, 96 as described above, the person may accomplish this by rotating one of the polarizing filters 94, 96 of relatively brighter interior illumination assemblies in a direction diminishing light transmission through the filters, and/or rotating one of the polarizing filters 94, 96 of a relatively darker interior illumination assembly 10 in a direction increasing light transmission through the filters.

Where the upper filter 94 of the relatively rotatable filters is fixed relative to the lamp housing 16, the LED dimmer 92 may be adjusted by rotating the lower filter 96 of the two polarizing filters 94, 96 relative to the upper filter 94. To gain access to the lower filter 96 of the two polarizing filters 94, 96 of the LED dimmer 92 an operator may apply a suction cup 140 to the lower filter 96 such that a central axis of the suction cup 140 is generally aligned with a rotational axis of the lower filter 96, and rotate the lower filter by rotating the suction cup. The suction cup 140 may be coaxially supported on an elongated member such as a stick 142 such that a longitudinal axis of the stick is generally coaxially arranged relative to the central axis of the suction cup. The stick 142 may then be used to extend the reach of the operator. The suction cup 140 may be rotated by rotating the stick 142 supporting the cup.

The LED lamps of an interior illumination assembly 10 constructed according to the invention are harder to steal than the lamps of current designs because a special tool must be used to remove an LED module 32 of such an assembly 10. In addition, the superior longevity of LED lamps dramatically reduces the frequency of lamp replacement over incandescent lamp use—especially in light of the fact that elevator lights generally burn continuously. Also, since LED lamps are less likely to fail, in elevator applications especially, passenger safety is enhanced. The magnifying lenses 68 of an interior illumination assembly 10 constructed according to the invention provide more light with less energy and fulfill elevator code requirements for protecting passengers from bulb breakage. A single interior illumination assembly 10 constructed according to the invention and including at least two LEDs has the additional advantage of meeting elevator code requirements for emergency lighting. This is because the emergency light power supply 124 that may be included in an assembly allows the assembly to surpass the elevator code requirement (set forth in ASME A17.1-2004 section 2.14.7.1.3) to power at least two bulbs of equal wattage for at least 4 hours. Further regarding the emergency illumination system 122, the use of LEDs allows for the use of an emergency power supply of reduced size and weight, which are important factor in elevators due to the limited size of elevator plenums and the limited power output of elevator motors/hydraulic pumps. The use of LEDs also allows for reduced interior illumination assembly size and weight due to the relatively lower power demand of LEDs and consequent reduction in size and weight of batteries 126 required for emergency operation.

This description, rather than describing limitations of an invention, only illustrates embodiments of the invention that's recited in the claims. The language of this description is therefore exclusively descriptive and is non-limiting.

Obviously, it's possible to modify this invention from what the description teaches. Within the scope of the claims, one may practice the invention other than as described above.

What is claimed is:

1. A method for equalizing light levels emitted into a compartment by illumination assemblies that use LEDs to produce light, the method including the steps of:

providing a compartment configured to receive at least one human occupant;

supporting at least two illumination assemblies on a ceiling panel of the compartment in respective positions to emit light downward into the compartment, each such illumination assembly comprising at least one LED, and at least one assembly of which comprises an LED dimmer;

illuminating the compartment by applying electrical power to at least one LED in each of at least two of the illumination assemblies;

entering the compartment;

gaining access to the LED dimmer of at least one of the illumination assemblies from a position within the compartment and below the ceiling panel; and adjusting the light emission level of at least one of the illumination assemblies to generally match that of another of the illumination assemblies by adjusting the LED dimmer of the at least one illumination assembly.

2. The method of claim 1 in which:

the step of providing a compartment with at least two illumination assemblies includes providing at least one illumination assembly comprising a lamp housing carrying the at least one LED, and an LED dimmer having two polarizing filters carried by the lamp housing below the at least one LED and coaxially supported for relative rotation between conditions of parallel polarization and cross-polarization, a first filter of the two polarizing filters being fixed against rotation relative to the lamp housing, a second filter of the two polarizing filters being supported for rotation relative to the first filter; and the step of adjusting the LED dimmer includes rotating one of the two polarizing filters relative to the other filter.

3. The method of claim 2 in which:

the step of providing at least one illumination assembly includes the first filter being an upper filter of the two polarizing filters and the second filter being a lower filter of the two polarizing filters; and the step of adjusting the LED dimmer includes rotating the lower filter of the two polarizing filters relative to the upper filter.

4. The method of claim 3 in which the step of adjusting the LED dimmer includes rotating the lower filter of the two polarizing filters of an LED dimmer of a relatively brighter illumination assembly in a direction diminishing light transmission through the filters.

5. The method of claim 3 in which the step of adjusting the LED dimmer includes rotating the lower filter of the two polarizing filters of an LED dimmer of a relatively darker illumination assembly in a direction increasing light transmission through the filters.

6. A method for equalizing emitted light levels between illumination assemblies that use LEDs to produce light, the method including the steps of:

providing a compartment with at least two illumination assemblies that each comprise a lamp housing carrying at least one LED, at least one assembly of which comprises an LED dimmer having two polarizing filters carried by the lamp housing below the at least one LED and coaxially supported for relative rotation between conditions of parallel polarization and cross-polarization, an upper filter of the two polarizing filters being fixed against rotation relative to the lamp housing, a lower filter of the two polarizing filters being supported for rotation relative to the upper filter and accessible from within the compartment to adjust the amount of light emitted by the assembly into the compartment;

gaining access to the LED dimmer of at least one illumination assembly from within the compartment;

adjusting the light emission level of at least one of the illumination assemblies to generally match that of another of the illumination assemblies by adjusting the LED dimmer of the at least one illumination assembly by rotating its lower filter relative to its upper filter;

in the step of gaining access to the LED dimmer, performing the steps of:

providing a suction cup;

applying the suction cup to the lower filter; and in the step of rotating the lower filter, moving the suction cup such that rotational motion is imparted to the lower filter.

7. The method of claim 6 in which:

the step of applying a suction cup to the lower filter includes applying the suction cup to the lower filter such that a central axis of the suction cup is generally aligned with a rotational axis of the lower filter; and the step of moving the suction cup includes rotating the suction cup about its central axis.

8. The method of claim 7 in which:

the step of providing a suction cup includes providing a suction cup coaxially supported on an elongated member;

the step of applying the suction cup to the lower filter includes holding the elongated member and directing the suction cup toward and into coaxial alignment and engagement with the lower filter; and the step of moving the suction cup includes rotating the elongated member about its longitudinal axis.

* * * * *